US005305853A

United States Patent [19]

Ross et al.

[11] Patent Number: 5,305,853

[45] Date of Patent: Apr. 26, 1994

[54] LUBRICANT STICK APPLICATOR

[75] Inventors: Robert C. Ross, Shawnee, Kans.; Michael B. Myers, Staffordshire, England; William A. Stallings, Atglen, Pa.; Harold A. Vaughan, Independence, Mo.

[73] Assignee: Century Lubricants Co., Kansas City, Kans.

[21] Appl. No.: 947,340

[22] Filed: Sep. 18, 1992

[51] Int. Cl.[5] ..... B61K 3/00

[52] U.S. Cl. ..... 184/3.2; 184/99; 221/231; 221/236

[58] Field of Search ..... 184/2, 3.1, 3.2, 45.1, 184/99; 295/35; 198/500; 104/279; 221/231, 232, 236, 53

[56] References Cited

U.S. PATENT DOCUMENTS

| | | | |
|---|---|---|---|
| 860,048 | 7/1907 | Miner . | |
| 1,043,141 | 11/1912 | Plymale . | |
| 1,092,738 | 4/1914 | Miner . | |
| 1,185,682 | 6/1916 | Kirkegaard . | |
| 1,222,341 | 4/1917 | Wholey . | |
| 1,635,603 | 7/1927 | Black . | |
| 1,685,040 | 9/1928 | Zbinden . | |
| 1,780,464 | 11/1930 | Coppage . | |
| 1,820,815 | 8/1931 | Maney | 184/3.1 |
| 2,106,665 | 1/1938 | Skinner . | |
| 2,203,112 | 6/1940 | Swanson . | |
| 2,580,687 | 1/1952 | McMillan . | |
| 2,589,582 | 3/1952 | Strughold et al. . | |
| 2,614,661 | 10/1952 | Fisher . | |
| 2,637,411 | 5/1953 | Harrison . | |
| 2,727,589 | 12/1955 | Campney . | |
| 2,866,521 | 12/1958 | Gibson . | |
| 3,011,590 | 12/1961 | Oullette . | |
| 4,811,818 | 3/1989 | Jamison . | |
| 5,054,582 | 10/1991 | Aracil . | |

FOREIGN PATENT DOCUMENTS

| | | | |
|---|---|---|---|
| 136272 | of 0000 | Canada . | |
| 130713 | 1/1911 | Canada | 184/3.1 |
| 131622 | 3/1911 | Canada . | |
| 42441 | 8/1912 | Canada . | |
| 164375 | 8/1915 | Canada . | |
| 320283 | 3/1932 | Canada . | |
| 357557 | 5/1936 | Canada | 184/3.1 |
| 465482 | 5/1950 | Canada . | |
| 533250 | 11/1956 | Canada . | |
| 620060 | 5/1961 | Canada . | |
| 621415 | 6/1961 | Canada . | |
| 623900 | 7/1961 | Canada . | |
| 1058529 | 7/1979 | Canada . | |
| 77956 | 11/1894 | Fed. Rep. of Germany . | |

*Primary Examiner*—Thomas E. Denion
*Attorney, Agent, or Firm*—Dority & Manning

[57] ABSTRACT

An apparatus for applying anti-frictional compound such as stick lubricant to a surface to be lubricated, for example a selected area of a railroad car wheel, includes a magazine for retaining a plurality of sticks or rods of the compound; a mechanism for guiding an individual stick or rod and directing it into contact with the surface to be lubricated. The apparatus sequentially draws individual sticks or rods from the magazine and locates each one, in sequence, in the guideway until the magazine is empty. The apparatus applies a constant pressure on the lubricant to the area to be lubricated.

20 Claims, 11 Drawing Sheets

LUBRICANT STICK APPLICATOR

FIELD OF THE INVENTION

This invention generally relates to devices that are useful for holding and applying stick lubricants to moving surfaces. An example of the type of moving surface that the lubricant is applied to is the steel wheels on trains and other rolling stock. By reason of the present invention continuous long term application of solid stick lubricant to such rolling stock is made possible.

BACKGROUND OF THE INVENTION

Over the last two decades there has been a significant increase in the presence of motorized rail transportation in urban areas resulting in an increasing need for methods of reducing the high frequency sounds which result from the twisting of the axle and sudden subsequent release of the twist as a curved rail is negotiated by the wheels of a train.

Much of the present technology developed to reduce this noise and generally lubricate the contact between train wheels and railway track has been to pump oil under pressure through nozzles directed at the wheel contact point with the track. Such technology leaves oil on the track and surrounding area, the latter being of environmental concern. Due to this concern the United States Environmental Protection Agency has indicated that this type of technology will be phased out.

Recently, solid stick lubricants have increased in popularity and have been useful for reducing friction and otherwise varying the frictional characteristics of steel to steel contact between train wheels and railway tracks. Although a lubricating device for applying lubricant to the inner side of outer railroad curves has been disclosed as a means of reducing the friction (U.S. Pat. No. 1,820,815—Maney), in a typical application, a stick lubricant is applied by a holding means to the wheel flange and/or tread of a train.

The stick lubricants have generally been applied to the wheel by a pushing mechanism contained in a device which holds a stick in position. The spring loaded applicator stick system as taught in U.S. Pat. No. 5,054,582 by Aracil is one such device.

The concept of a self controlling lubricating system mounted to the vehicle as designed for rail cars is well known and has been disclosed at least as early as 1910 (Canadian Patent No. 156,866—Conniff). Others in that time period include Canadian Patent No. 163,700—Gerlinger and Canadian Patent No. 167,026—Miner.

A number of other lubricator stick assembly systems subsequently disclosed in the art include U.S. Pat. No. 1,780,464—Coppage; U.S. Pat. No. 2,866,521—Gibson; U.S. Pat. No. 2,727,589—Capney; U.S. Pat. No. 2,589,582—Strugghold; U.S. Pat. No. 2,326,000—Teeple; U.S. Pat. No. 1,185,682—Kirkegard; and U.S. Pat. No. 1,102,473—Chappell, the most recent being that of AraCil (U.S. Pat. No. 5,054,582).

Most locomotives are serviced at approximately 92 day intervals or after approximately 40,000 to 60,000 miles of travel. Currently, a single lubricant stick lasts on average for approximately 15,000 miles of travel. Space limitations restrict the stick length that can be applied to the wheel. Consequently, there is a need for providing longer lasting lubricating.

There is a general lack of space on locomotives and rolling stock in the area of the inside center line of the wheels where the lubrication is most advantageously applied. Tube assemblies, step ladders, storage tanks, etc. all vie for space in this area. Lengthening the stick lubricant is therefore impractical.

SUMMARY OF THE INVENTION

A multiple stick feeder system that holds and dispenses a sufficient number of stick lubricants to reduce the frequency of replacement of sticks and thereby reduce maintenance costs represents a more practical solution. Problems for a multiple stick dispenser are that it needs to be as compact as possible with a shape that can be mounted in the required location on a maximum number of railcars. It must be large enough to store sufficient footage of stick to lubricate a wheel running an estimated milage of at least 80,000 miles or for a period of not less than 92 days. The present invention provides a solution to all of these problems.

The invention herein comprises an apparatus for holding and continuously advancing a plurality of solid lubricant sticks into contact with a moving surface.

In accordance with the present invention there is provided a spring loaded apparatus, which is charged by winding, the motive force of which powers a driving mechanism which advances a lubricator stick through a dispensing means into contact with a moving surface, said driving mechanism advancing said stick by turning a conveyor belt means which supports the stick and advances it by a pushing tab means affixed to the conveyor belt.

In addition a constant force spring loaded level mechanism uniformly urges a plurality of lubricator sticks in a container unit towards the conveyor belt. As the first stick on the belt advances into the dispensing position, a second stick is urged into place on the belt immediately behind the first stick. Once this second stick has moved far enough toward the dispensing position the space behind, once large enough, is immediately filled by the next stick from the loading mechanism and so on until the plurality of lubricator sticks in the container unit is exhausted.

The stick located in the lubricating position, when lubricating a train wheel flange, will experience back and forth motion (a pumping action) on the conveyor belt as a result of the wobble of the wheel forcing the stick back into the dispensing unit and the opposing motive force driving the stick end onto the wheel surface. The backward force will be transmitted through all sticks on the conveyor urging the back end of the stick furthest from the wheel toward the back casing of the dispenser. Any interaction of this back end of a stick with the dispenser wall could lead to stick breakage. A further aspect of the invention provides a means to prevent any pumping action causing contact of the lubricating sticks in the dispensing position on the conveyor belt with the dispenser back wall.

In another embodiment there is described a battery or electrically powered mechanism to drive the conveyor belt in conjunction with a constant force spring loaded level mechanism.

BRIEF DESCRIPTION OF THE DRAWINGS

The invention is illustrated by way of example in the accompany drawings in which.

DETAILED DESCRIPTION OF PREFERRED EMBODIMENTS

In the following descriptions the corresponding elements as shown in each figure of the drawings are given the same reference number.

Figure 1:
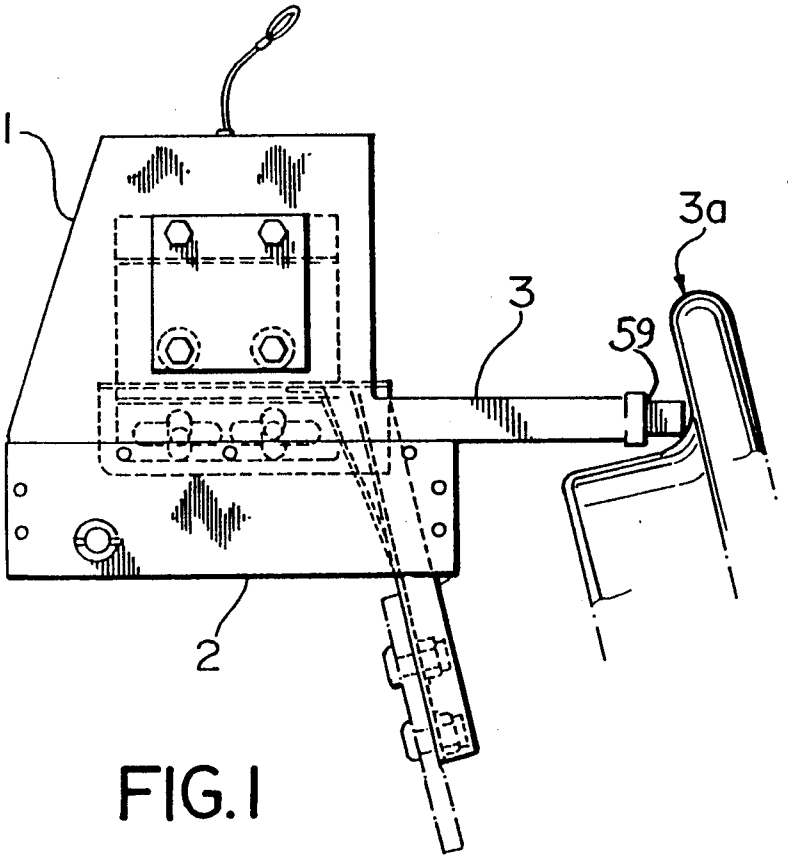
FIG. 1 is a top view of the device with a lubricating stick in the dispensing arm in position on a train wheel.

Referring to FIG. 1 a dispenser assembly according to the invention comprises a holding unit 1 for containing a plurality of lubricating sticks, and a bottom assembly 2 enclosing a spring-loaded, stick advancing mechanism. A dispensing arm 3 faces a wheel 3*a* and supports the lubricating stick which engages the surface of the wheel.

Figure 2:
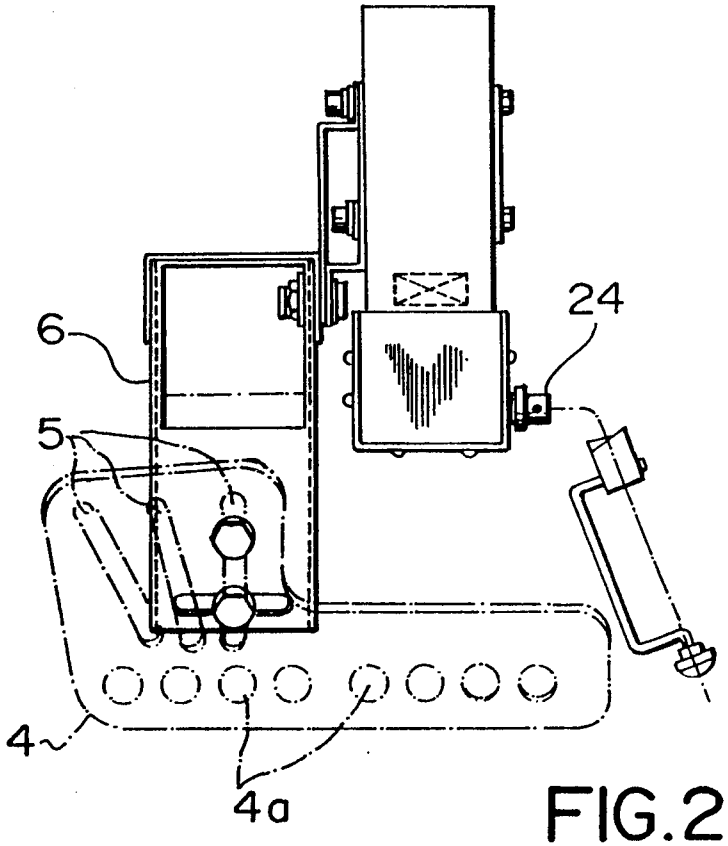
FIG. 2 is a front view (from the perspective of the wheel) of the device of FIG. 1.

As can be seen in FIG. 2 the multiple stick dispenser assembly is attached to the frame of a railroad car by means of a base plate 4 containing a series of holes 4*a* for directly mounting the unit to the frame opposite the wheel. Plate 4 also includes a plurality of slots 5 to provide a range of adjustments of the orientation of the dispenser assembly which is attached to plate 4 by bracket 6.

Figure 3:
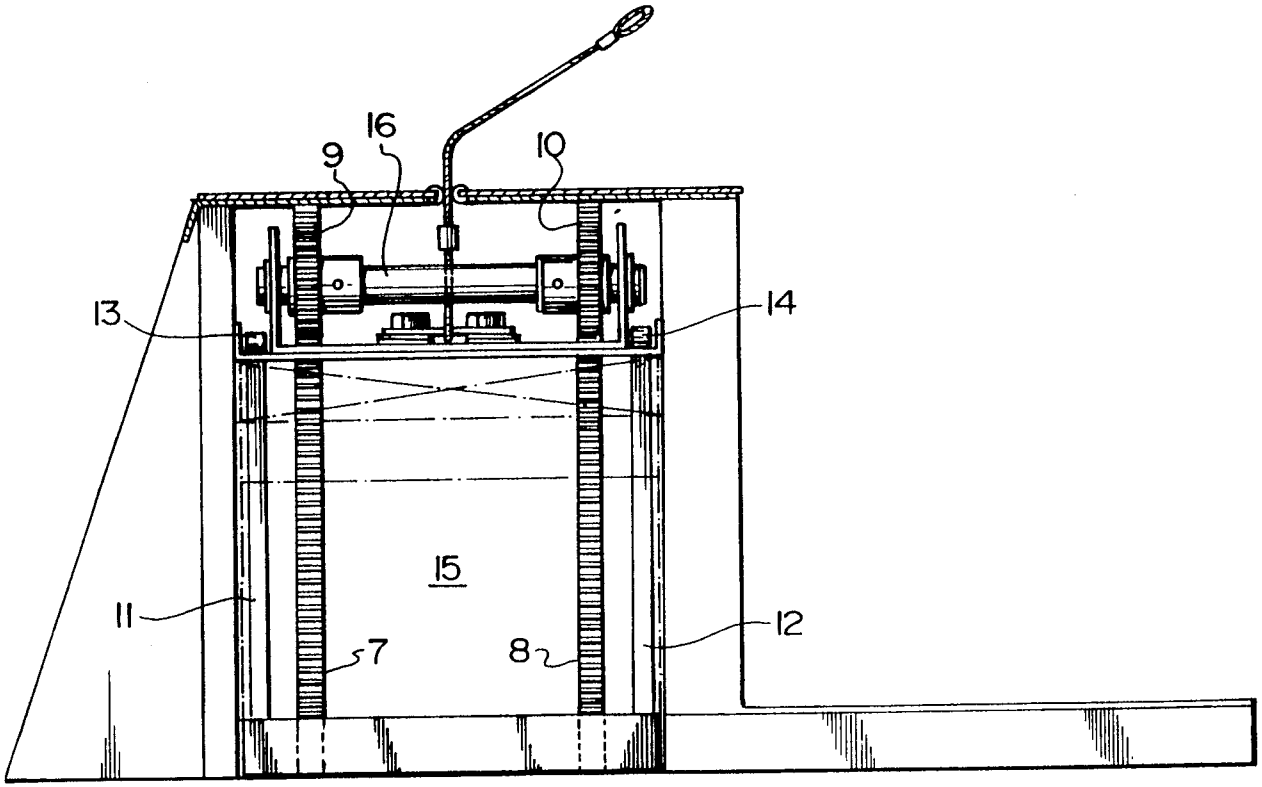
FIG. 3 is a cut away view of the multiple stick container unit and constant force spring level drive of FIG. 1.

FIG. 3 illustrates a multiple stick holding unit assembly containing two sets of racks 7 and 8. Each set consists of two racks which can be seen in FIG. 5 (8, 8*a*). One rack of each set thereof is located on each side of the stick holding unit. Racks 7 and 8 are notched and inter-digitate with the spur gear portion of two sets of facing gears, 9 and 10, where the second set thereof, namely 10*a*, can be seen in FIG. 5. Parallel to the racks 7 and 8 are two sets of longitudinal tracks 11 and 12 including two sets of double spiral negator springs 13 and 14 where the second thereof, namely 14*a*, can be seen in FIG. 5. These negator springs provide the force to urge the gear bracket assembly towards the conveyor belt means. Thus the preferred embodiment of the holding unit contains four racks, namely two of each of 7 and 8; four spur gears, namely two of each of 9 and 10; four negator springs, namely two of each of 13 and 14; and four negator spring tracks, namely two of each of 11 and 12.

The gear bracket assembly mechanism provides a level feed mechanism and a level wind mechanism such that the lubricating sticks held in the container unit are pushed in an uniform fashion. The said sticks are located in space 15. Preferably at least seven lubricating sticks would be contained therein.

Figure 5:
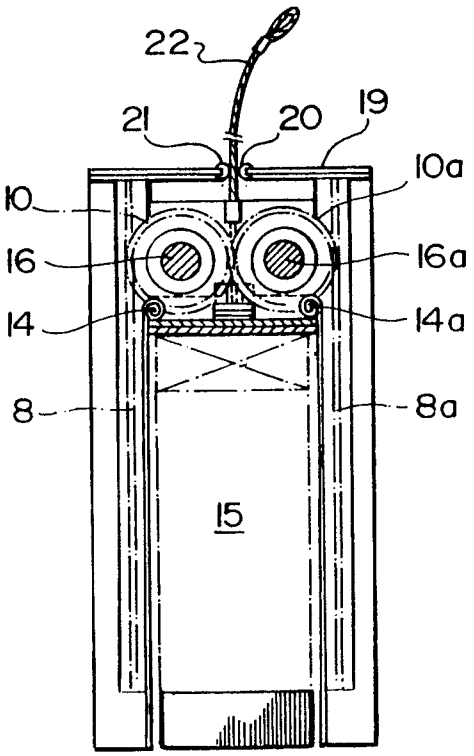
FIG. 5 is a side view of the gear bracket assembly of the container unit of FIG. 1.

Referring to FIG. 5 it can be seen that racks 8 and 8*a* are located on both sides of the unit such that two gears 10 and 10*a*, each on its own shaft 16 and 16*a* respectively are in contact with each other as well as with the corresponding racks. All four gears are fixed in position to maintain a level surface for a level feeding of the lubricating sticks.

Figure 4:
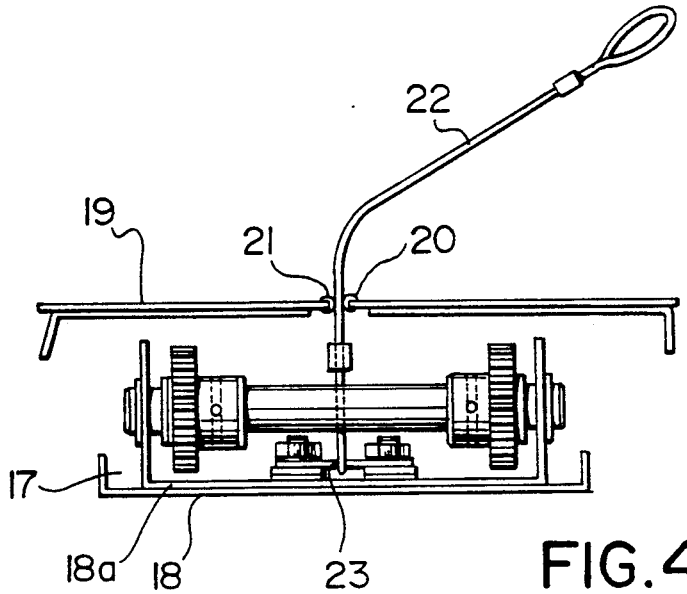
FIG. 4 illustrates the gear bracket assembly of the multiple stick drive mechanism in the container unit of FIG. 1.

Referring to FIG. 4, the coil portion of the negator spring rests in space 17. The pressure pushing plate 18 which urges the lubricating sticks is shorter than the length of the lubricating stick so that it may ride down onto the delivery chain after the last stick has been expelled from the dispenser. Plate 18 is welded to the plate 18*a* which supports the gear bracket assembly.

The housing which comprises the holding unit 19 contains an aperture 20 and grommet 21 therein through which a cable 22 passes and is attached by a metal plate 23 to the pressure plate 18. Cable 22 is drawn to return the entire driving mechanism to its start position allowing the empty chamber to be filled with lubricating sticks.

Figure 6:
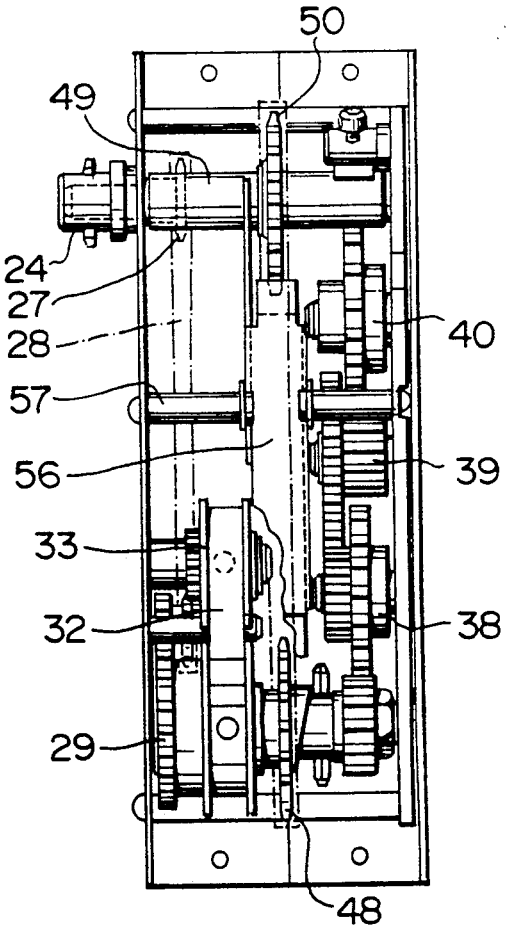
FIG. 6 is the top view of the bottom assembly illustrating the spring loaded stick advancing mechanism of FIG. 1.
Figure 8:
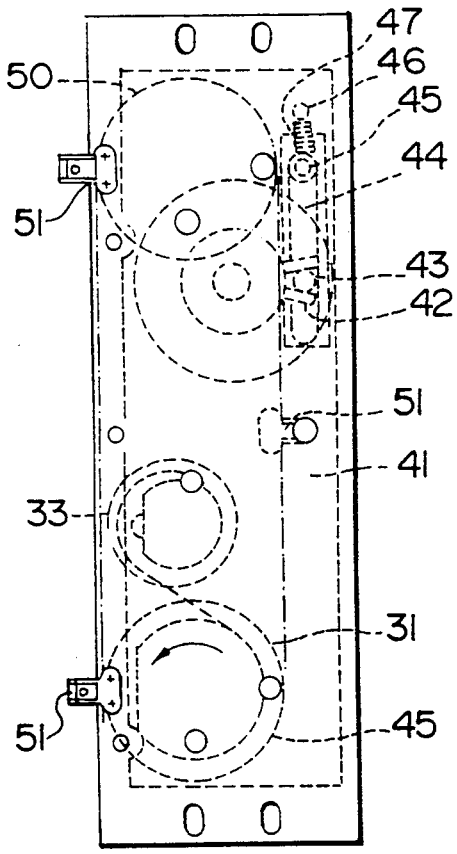
FIG. 8 is the side view of the bottom assembly of spring powered mechanism for moving the lubricating stick of FIG. 1.
Figure 9:
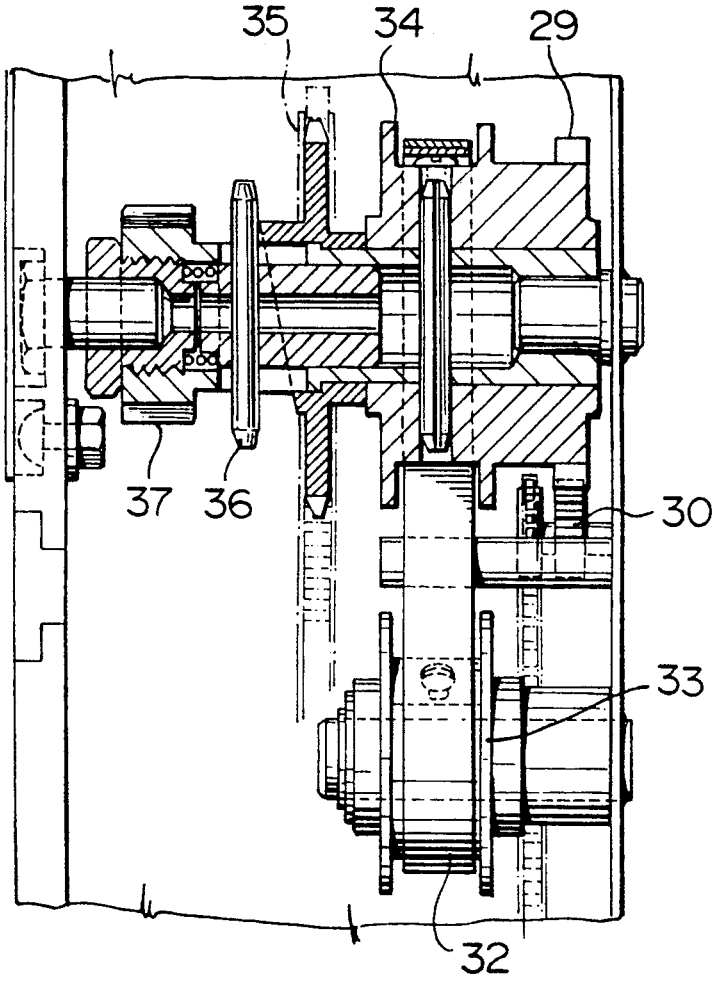
FIG. 9 illustrates the spring drum and front drive shaft assembly of FIG. 6.
Figure 10:
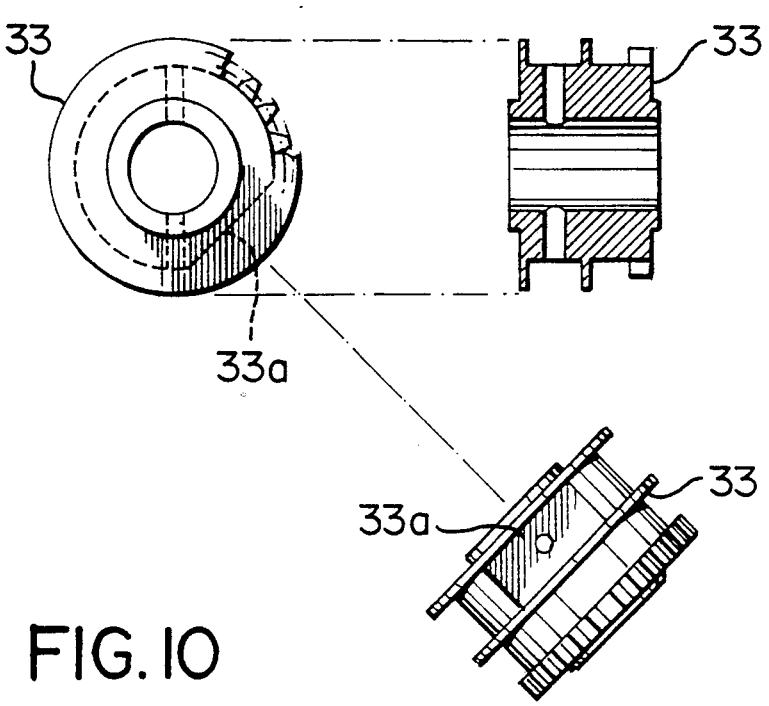
FIG. 10 illustrates the spring drive drum of FIG. 9 in detail.
Figure 11:
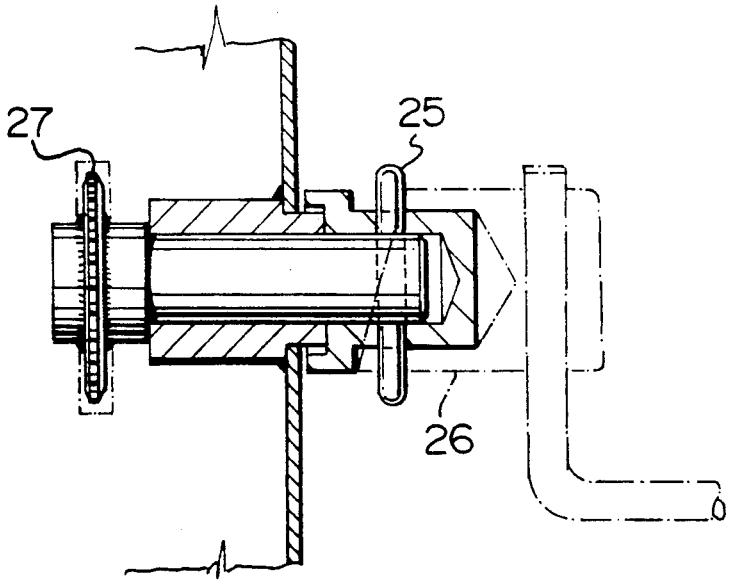
FIG. 11 illustrates the rear winder sprocket of FIG. 6.
Figure 16:
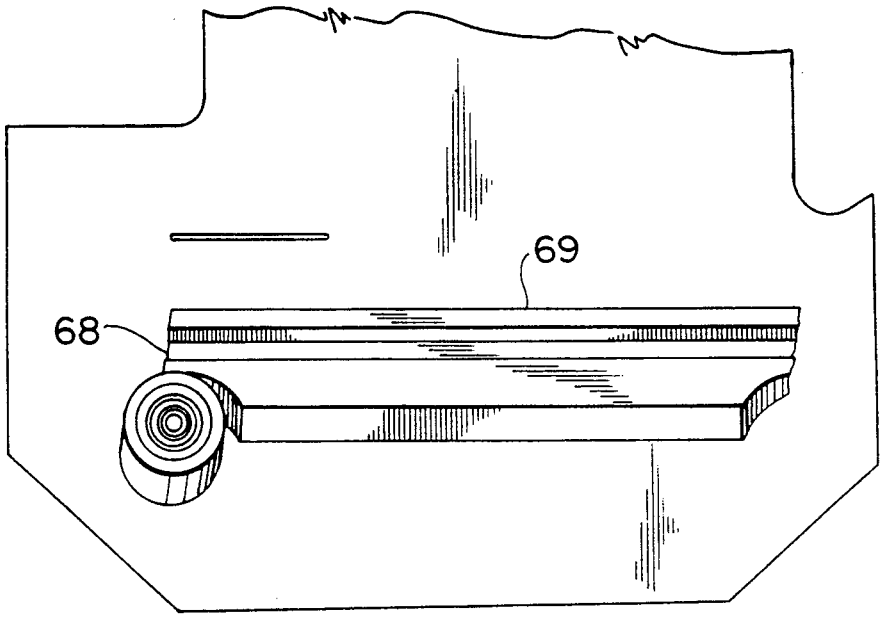
FIG. 16 illustrates a guide for maintaining level travel of the drive chain of FIG. 14.

FIG. 6 is a top view of the bottom assembly unit. The winder assembly shaft 24 therein is further illustrated in FIG. 13. In FIG. 11, 25 represents a center pin which engages the turning portion of the winder wrench weld assembly 26. When the winder wrench engages the center pin of this rear winder and is turned in a clockwise direction, the sprocket at 27 engages a winder chain which is shown as 28 on FIG. 6, and is better seen in FIG. 13. This chain engages the sprocket 29 on the front drive by means of the front winder sprocket 30 (FIG. 9 and 16). The rotation of the winder chain turns this front drive shaft in a clockwise direction as illustrated in FIG. 8 at 31. As the front drive shaft is turned in this clockwise direction it causes the spring 32 of the spring drum 33 to be wound and turns a series of three reduction gears which are illustrated on the right side of the bottom assembly unit in FIG. 6. The spring is fixed to a flattened portion 33*a* on the hub of the spring drum as illustrated in FIG. 10.

FIG. 9 illustrates the front drive shaft in the upper area of the figure. The points of contact and engaging portions which turn are 29 which is connected to the winder mechanism, 34 which in turn charges the spring drum with energy as the spring contained on the drum is unwound by virtue of the winding. 35 is a ratchet sprocket that carries the conveyor belt on top of which the lubricating sticks are carried; 36 is a spring loaded pin that allows the sprocket to ratchet when the drive spring is wound and allows the sprocket to drive in the opposite direction; and 37 is a spur gear which makes the connection to the first of three reduction gears.

The three reduction gears, fixed to an inner wall 41, are pictured in FIG. 6 and labelled as 38, 39 and 40. These gears are made to provide, for example, an 11:1 reduction in the number of turns from the front drive shaft to the third reduction gear. Consequently, in such an example, eleven rotations of the front drive shaft results in one complete rotation of the third reduction gear 40.

A side view of the third reduction gear is provided in FIG. 8 which illustrates a tab 42 which extends from the outer aspect of the third reduction gear 40 toward the housing. Also illustrated in FIG. 8 is a metal pin 43 contained in the space between the inner wall 41 and the housing and extending toward the third reduction gear 40 where said pin is fixed on a metal sliding means 44 which is in turn affixed to the housing allowing it to move in a direction parallel to the housing. The other end of the sliding means contains a second pin 45 which is affixed to a third pin 46 by means of a compression spring 47. The fixed pin 46 is welded to the housing wall.

When the third reduction gear 40 is rotated by virtue of winding the mechanism and is near the end of one complete revolution, the tab 42 engages the pin 43 urging the sliding mechanism in a direction toward the fixed pin 46. When the compression spring 47 is completely compressed the sliding means 44 becomes immovable and the third reduction gear 40 is no longer able to turn in this direction. At this point the tab 42 on the reduction gear 40 is in the "wound position". Once in this position the spring drum 33 has been sufficiently charged to cause the front drive shaft to effect a series of rotations which is sufficient to drive or dispense a fully loaded holding unit of its lubricant sticks.

Figure 13:
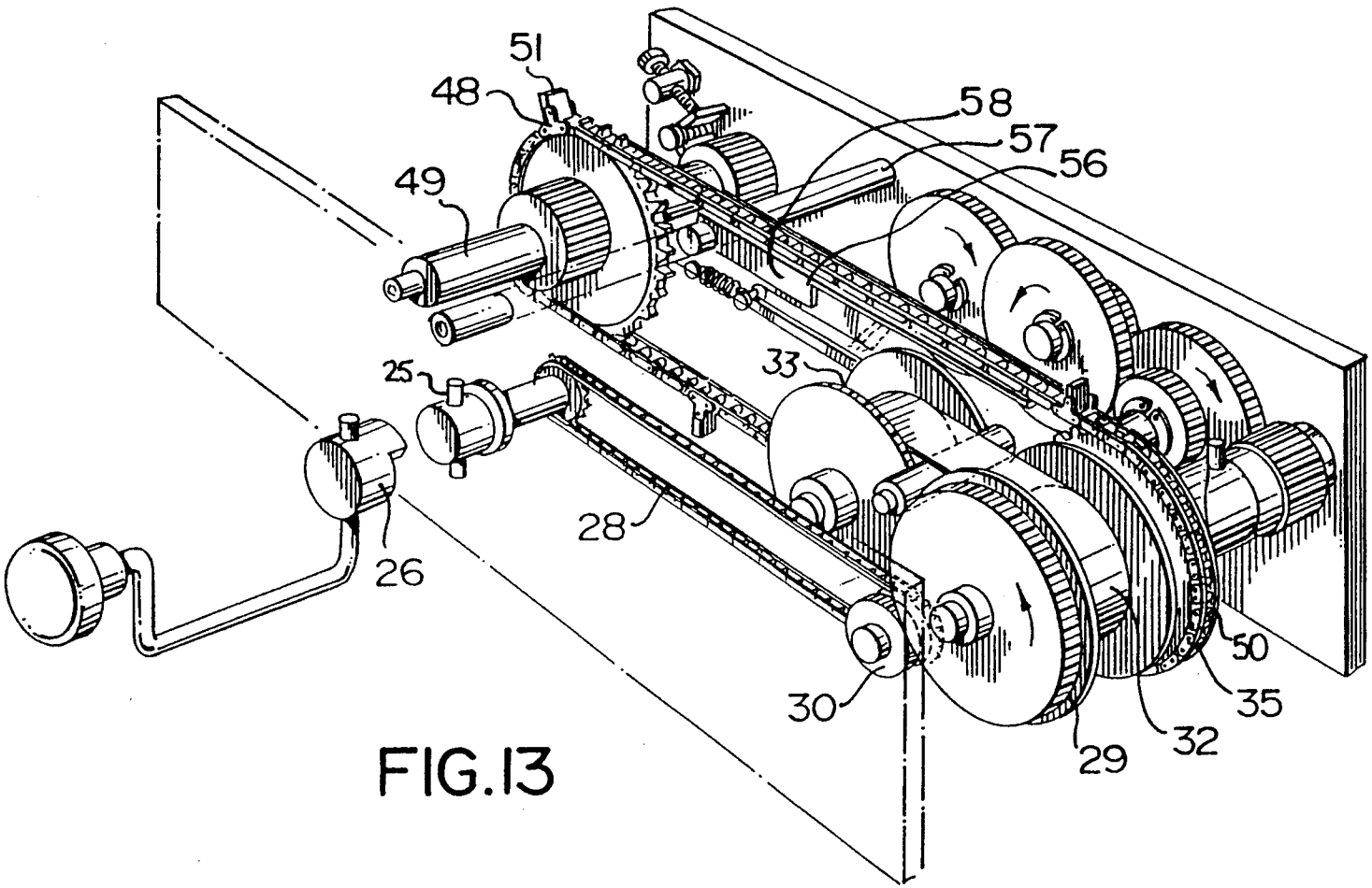
FIG. 13 illustrates an exploded view of the bottom assembly of FIG. 1.

Referring to FIG. 13 the conveyor belt mechanism comprises a chain 48 which extends from the rear shaft 49 to the front drive shaft assembly encircling both shafts at sprockets 50 and 35. The ratchet sprocket 35 of the front drive shaft assembly engages the drive chain, advancing by means of the energy provided to it from the spring 32 and spring drum 33. Any backward motion of the drive chain resulting from pumping is taken up by this ratchet sprocket.

The chain 48 consists of three pieces of chain connected with snap links 51. Each of these snap links provides a means to hold a small [brass] block which is the pushing tab that engages the back end of the lubricating stick.

Figure 7:
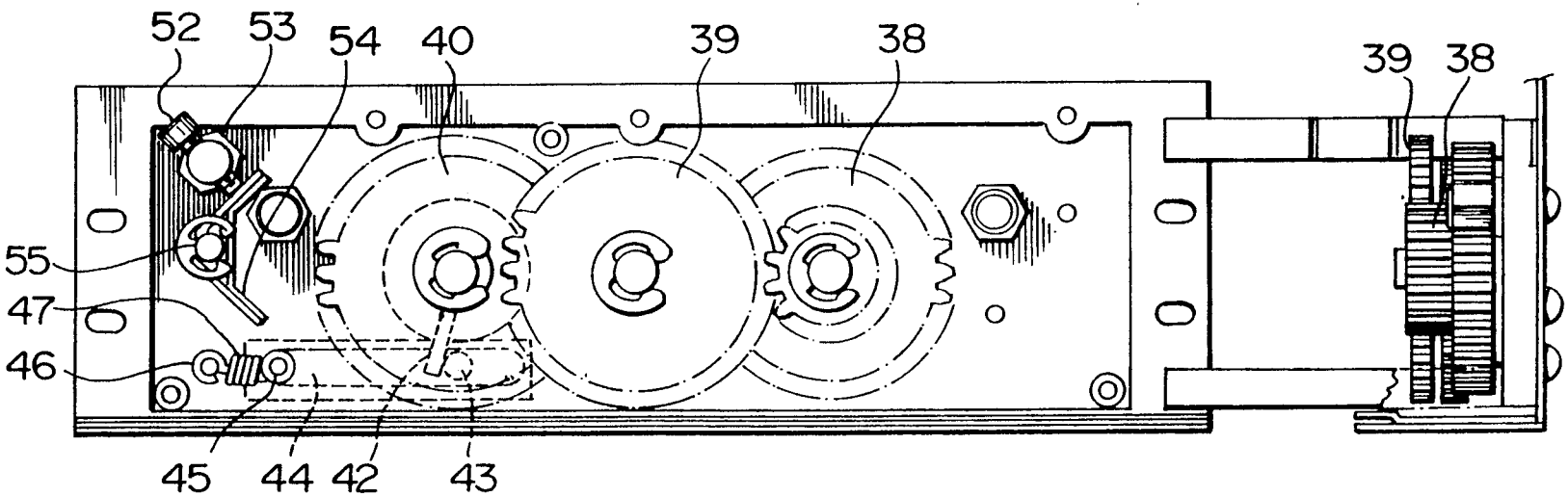
FIG. 7 is a left hand view of the bottom assembly of FIG. 6 illustrating reduction gears and snubber mechanism of FIG. 1.

The rear shaft 49 is adjusted for fit with the drive chain 48 by a tension adjustment means illustrated in FIG. 7. The tension adjustment means consists of a screw 52 with a nylon insert passing through a screwing means 53 and contacting a swinging link 54. The swinging link is held at its apex by a fixed holding means 55. The swinging link 54 is a V-shaped piece of metal, the arms of which are at right angles where the arms engage the rear shaft in a variable manner depending upon the tension imposed by the screw 52.

The drive chain 48 passes over a chain guide 56 and is illustrated in its preferred location in FIG. 13. The said chain guide is held in position by a cross member 57 which spans the width of the bottom assembly unit. The chain guide is of a length which is the distance between the front and rear shafts and of a width just greater than the greatest width of a lubricating stick. A flange 58 provides a guard for the reduction gear parts below the chain.

The exit site 59 of the dispensing arm 3 contains a boot composed of resilient material which provides a method of sealing the end of the arm to ensure that debris is not able to move into the dispensing arm and thereby enter into the bottom and top assembly. There, the boot "hugs" the perimeter of the lubricating stick.

Figure 12:
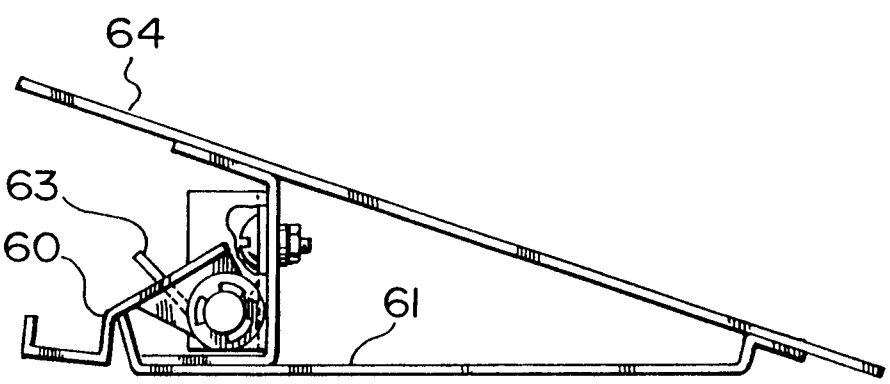
FIG. 12 illustrates, with respect to FIG. 1, the access door assembly and compensator for pumping action.
Figure 12:
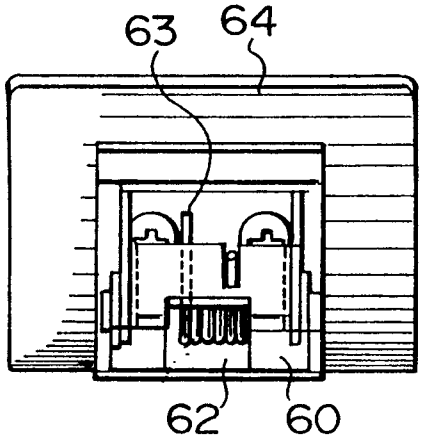

Forces that are applied to the vehicle wheel, as it secures the railcar to the track in moving around curves of the track, tend to move the flange in a back and forth motion perpendicular to direction of the track. In addition, the normal "wobble" of the wheel, i.e. lateral movement of the wheel rim with respect to the perfect movement the rim traces as it moves around the center line of its axle, also produces this same back and forth movement with each revolution of the wheel. Such motion is referred to as a pumping motion. The multiple stick dispenser must have a means not only to push the stick to the wheel flange with an essentially constant force for uniform wear but also must allow a degree of freedom in the opposite direction to compensate for the back and forth pumping action on the stick. When a second lubricating stick is in place on the drive chain behind the forward most lubricating stick (which stick is in contact with the vehicle wheel) the pumping action would cause the back end of the second stick to contact the interior wall of the housing. Such contact could provide sufficient force to break the lubricating stick. In order to overcome this problem a spring loaded link mechanism 60 is incorporated into a false rear wall 61 as illustrated in side view in FIG. 12. The lower portion of FIG. 12 provides a front view of the link 60. A space 62 is provided in this link through which the pusher tab 51 of the drive chain passes. The spring mechanism 63 provides sufficient torque to prevent the stick from moving completely to the true rear wall of the housing 64. 64 also represents the access door through which new sticks are supplied to the holding unit.

Figure 14:
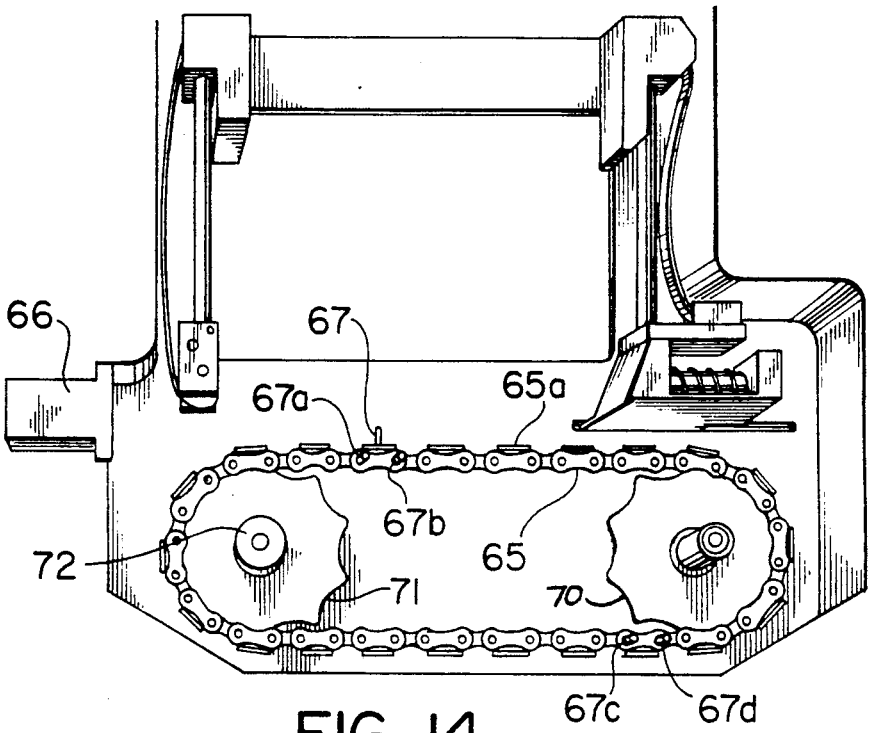
FIG. 14 illustrates a cross-sectional view of a further embodiment of the device.

In a further embodiment the lubricator stick travels along a conveyor belt drive chain 65 wherein each link of the conveyor belt drive chain has attached to its surface a mini platform **65*a* as can be seen in FIG. 14. In this embodiment as represented in cross-sectional view through a dispensing means 66. The lubricator stick is pushed by a tab 67 which is connected to a chain link of the drive chain. Pins 67*a* and 67*b* span the width of the housing of the device and are engaged by the track 68 located in the guide 69 illustrated in FIG. 16. Two such guides are contained within the housing of the device wherein each guide is located on one of the side walls. The engaging of these pins in the guide ensure proper alignment and linear travel of the drive chain as it advances. Pins 67*c* and 67*d* also span the width of the device and upon rotation around a rear sprocket 70** into the top position the pins engage the track of the guide. The guide may be composed of Delrin or such other suitable material.

The forward sprocket 71 rotates freely on a shaft 72 which spans the width of the housing for the device.

Figure 17:
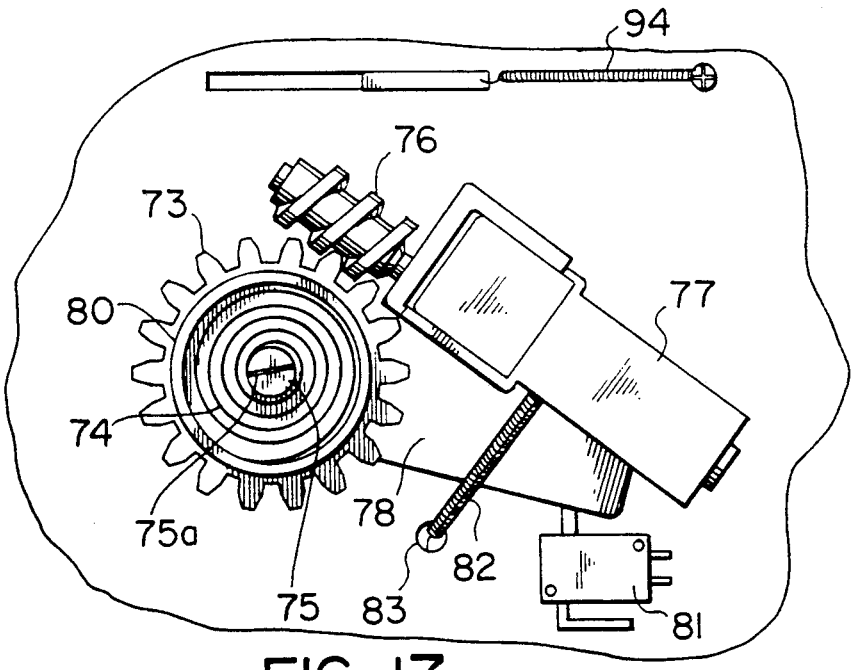
FIG. 17 is a detailed side view of the motor reducer unit with worm and gear, cup and spring of FIG. 19.
Figure 18:
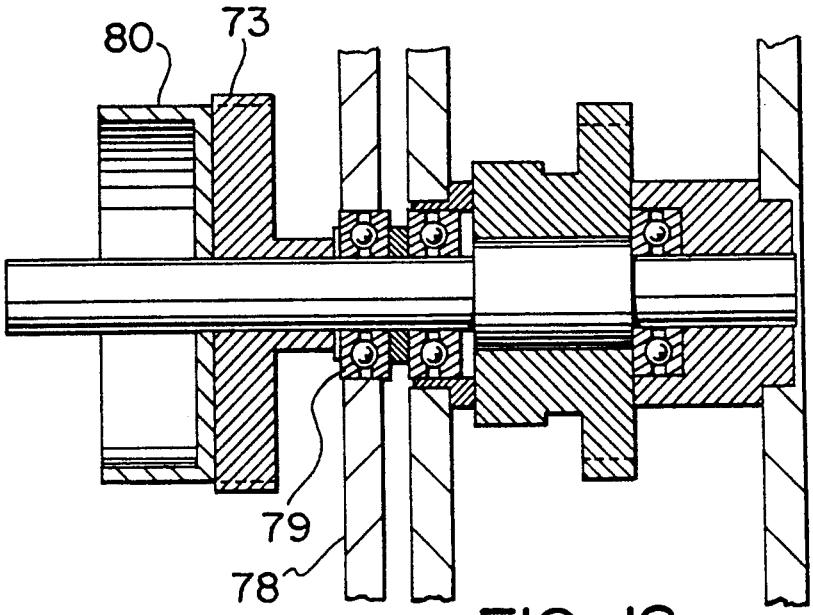
FIG. 18 is a cross-sectional view of the drive assembly and shaft of the embodiment of the device in FIG. 14.

The motive force for the drive chain is provided by means of a combination of a gear 73 and helical power spring 74, shaft 75 and power source such as a battery. Referring to FIG. 17 the gear 73 is engaged by the worm 76 which is driven by a motor combined with a reducer 77. The motor/reducer/worm unit as a unit is fixed to a plate 78 which is provided with a bearing means 79 (FIG. 18) to free float and allow movement of the plate 78 (FIG. 17) which holds the motor/reducer/-worm as a unitary assembly. Affixed to the gear 73 (FIG. 18) is a cup means 80 wherein the last wrap of the helical power spring 74 is fixed to said cup. The first wrap of the helical power spring is fixed into slot 75*a* of shaft 75 (FIG. 17). Plate 78 (FIG. 17) interacts with an electrical switch 81 Which provides power to the motor/reducer depending upon the switch position. When the motor/reducer 77 is powered, its turning force rotates the worm 76 which rotates the gear 73 and provides energy to the helical power spring 74. The motor/reducer is restrained from travelling completely around the shaft and out of position by a restraining spring 82 which is fixed to the housing by holding means 83. The energy generated in the helical power spring by action of the motor/reducer is relieved by turning the rear drive shaft 84 and drive chain 65 which action advances any lubricating stick on the surface of the drive chain.

Figure 15:
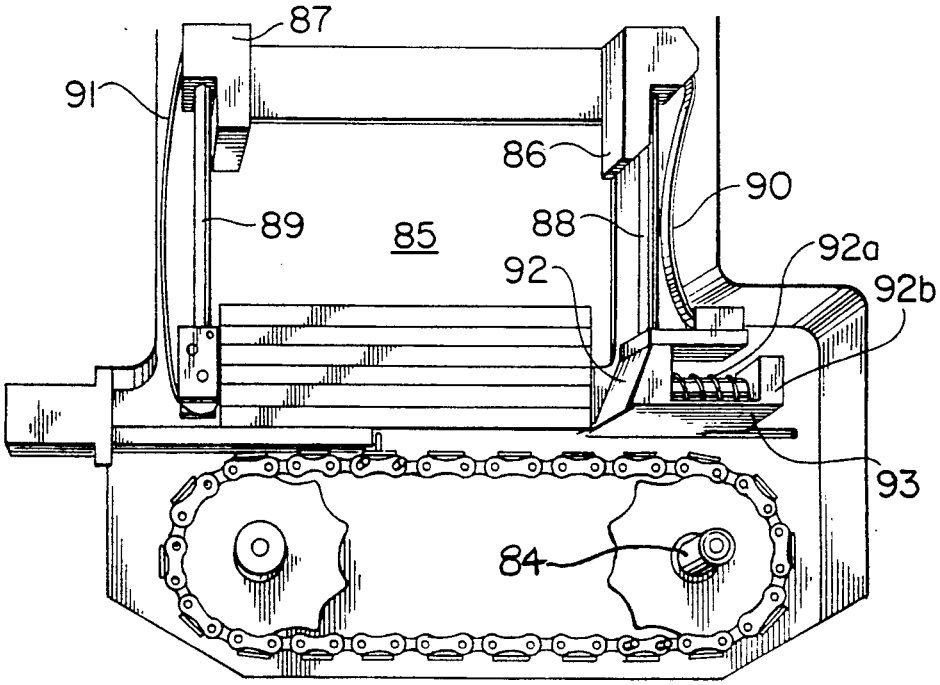
FIG. 15 illustrates a cross-sectional view of the embodiment of FIG. 14 containing a plurality of lubricator sticks in the holding chamber.

Referring to FIG. 15 a plurality of lubricator sticks can be held in the chamber 85. The lubricator sticks are urged toward the drive chain 65 by pushing blocks 86 and 87 which move up and down on shafts 88 and 89 respectively. These pushing blocks are urged toward the drive chain by reciprocating springs 90 and 91.

Figure 19:
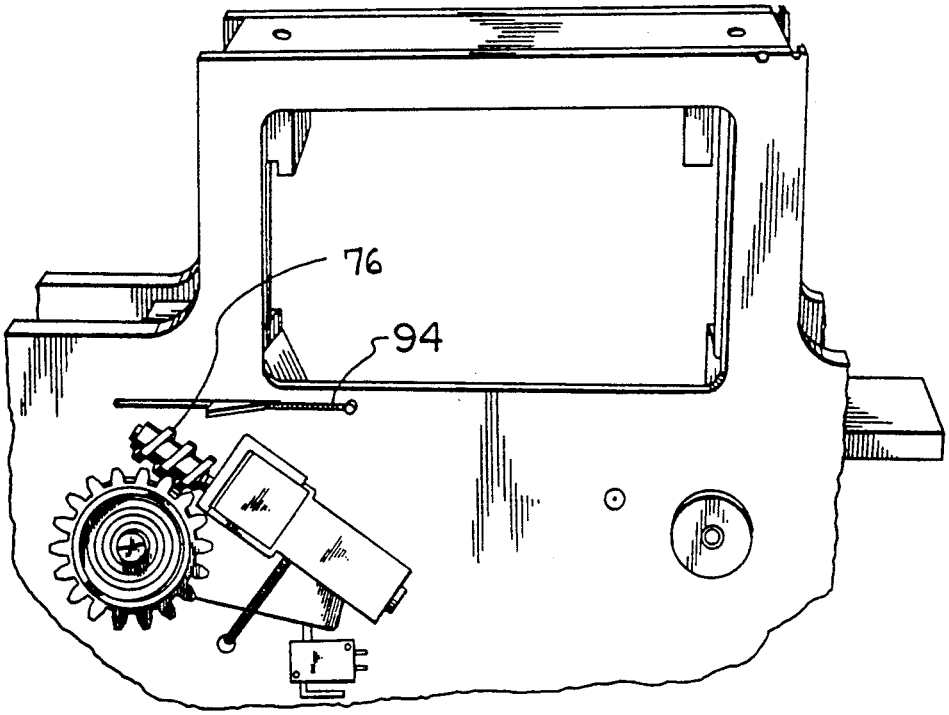
FIG. 19 is a side view of the embodiment of the device of FIG. 14.

As the lubricating stick which is in contact With the drive chain 65 is advanced toward the train wheel the stick next in position to move unto the drive chain is held at one end by the advancing lubricator stick and at the other end by a holding means 92. If the advancing lubricator stick moves out of the range for supporting the upper stick, that end will move to the surface of the drive chain. If at that moment pumping action is exerted on the dispensing lubricator stick the rear end of the next stick pushes on the holding means which compresses a spring 92*a* onto an opposing means 92*b*. Once the dispensing lubricator stick resumes advancement toward the wheel this second stick is carried forward off the holding means fully onto the drive chain 65. If however at the instant this stick is moving completely onto the drive chain a further pumping action is received, the ledge 93 (which supports the holding means) is able to move backward. This backward motion is restrained by a spring means 94 which is fixed on the exterior surface of the housing as illustrated in FIG. 19.

While the invention has been described in connection with two specific embodiments thereof and in a specific use, various modifications thereof will occur to those skilled in the art without departing from the spirit and scope of the invention as set forth in the appended claims.

The terms and expressions which have been employed in this specification are used as terms of description and not of limitations, and there is no intention in the use of such terms and expressions to exclude any equivalents of the features shown and described or portions thereof, but it is recognized that various modifications are possible within the scope of the invention claims.

We claim:

1. A dispensing apparatus for the controlled application of a plurality of solid lubricant sticks to an area of a wheel of a vehicle, said apparatus comprising:

a. a receptacle for retaining the plurality of lubricant sticks in a predetermined arrangement;

b. transport means operably connected to the receptacle for receiving the lubricant sticks form the receptacle and for moving the lubricant sticks sequentially from the receptacle into contact with the wheel area.

2. An apparatus as defined in claim 1 which further comprises compensating means to compensate for linear movement of the lubricant sticks normal to the rotary path of the wheel.

3. An apparatus as defined in claim 2 wherein the transport means comprises a conveyor adapted to support one or more of the lubricant sticks and is located in the apparatus such that it received the sticks longitudinally from the receptacle wherein the sticks are moved toward the conveyor by an urging means which moves from a full position to an empty position by a biasing means.

4. An apparatus as defined in claim 3 wherein a spring powered mechanism engages and drives the conveyor.

5. An apparatus as defined in claim 4 wherein the spring powered mechanism is manually wound.

6. An apparatus as defined in claim 4 wherein the spring powered mechanism is wound by a battery powered mechanism.

7. An apparatus as defined in claim 2 wherein the compensating means is a spring mechanism.

8. An apparatus as defined in claim 2 wherein the lubricant sticks contained in the receptacle in a parallel relationship and are piled longitudinally one on top of another in a position normal to the rotary path of the wheel.

9. An apparatus as defined in claim 6 wherein the receptacle is capable of being opened and closed to allow loading and unloading of lubricant sticks at any position between the full position and the empty position, including the empty and full positions.

10. An apparatus as defined in claim 2 further comprising means for mounting the apparatus whereby the mounting means is a plate and bracket wherein the plate is attached to the vehicle, the bracket is adjustably attached to the plate, and the bracket is attached to the apparatus.

11. A dispensing apparatus for the controlled application of a plurality of solid lubricant sticks to an area of a wheel of a vehicle, the apparatus comprising:

a. a receptacle for retaining the plurality of lubricant sticks;

b. transport means for moving the lubricant sticks sequentially from the receptacle into contact with the wheel area; and c. means for compensating for linear movement of the lubricant sticks normal to the rotary path of the wheel.

12. An apparatus as defined in claim 11 wherein the transport means comprises a conveyor adapted to support one or more of the lubricant sticks and is located in the apparatus such that it receives the sticks longitudinally from the receptacle wherein the sticks are moved toward the conveyor by an urging means which moves from a full position to an empty position by a biasing means.

13. An apparatus as defined in claim 12 wherein a spring powered mechanism engages and drives the conveyor.

14. An apparatus as defined in claim 13 wherein the spring powered mechanism is manually wound.

15. An apparatus as defined in claim 13 wherein the spring powered mechanism is wound by a battery powered mechanism.

16. An apparatus as defined in claim 11 wherein the compensating means is a spring mechanism.

17. An apparatus as defined in claim 11 wherein the lubricant sticks contained in the receptacle are piled in a parallel relationship and longitudinally one on top of another in a position normal to the rotary path of the wheel.

18. An apparatus as defined in claim 12 wherein the receptacle is capable of being opened and closed to allow loading and unloading of lubricant sticks at any position between the full position and the empty position, including the empty and full positions.

19. An apparatus as defined in claim 11 further comprising means for mounting the apparatus whereby the mounting means is a plate and bracket wherein the plate is attached to the vehicle, the bracket is adjustably attached to the plate, and the bracket is attached to the apparatus.

20. A lubricant stick dispensing apparatus for mounting on a railroad car or locomotive for the controlled application of a plurality of solid lubricant sticks to an area of a wheel of the railroad car or locomotive, the apparatus comprising:

a. a receptacle for retaining the plurality of lubricant sticks;

b. transport means for moving the lubricant sticks sequentially from the receptacle into contact with the wheel area;

c. means for compensating for linear movement of the lubricant sticks normal to the rotary path of the wheel; and d. a mounting plate and bracket.

* * * * *